United States Patent [19]

Honda et al.

[11] Patent Number: 4,939,057

[45] Date of Patent: Jul. 3, 1990

[54] SURFACE-TREATED METAL BODY, PROCESS FOR PRODUCING THE SAME, PHOTOCONDUCTIVE MEMBER USING THE SAME AND RIGID BALL FOR TREATING METAL BODY SURFACE

[75] Inventors: Mitsuru Honda, Kashiwa; Atsushi Koike, Chiba; Tomohiro Kimura, Ueno; Kyosuke Ogawa, Nabari; Keiichi Murai, Kasbiwa, all of Japan

[73] Assignee: Canon Kabushiki Kaisha, Tokyo, Japan

[21] Appl. No.: 294,995

[22] Filed: Jan. 9, 1989

Related U.S. Application Data

[63] Continuation of Ser. No. 894,958, Aug. 8, 1986, abandoned.

[30] Foreign Application Priority Data

Aug. 10, 1985 [JP] Japan ..... 60-176172

[51] Int. Cl.[5] ..... G03G 5/10

[52] U.S. Cl. ..... 430/69

[58] Field of Search ..... 427/34; 118/308; 430/69

[56] References Cited

U.S. PATENT DOCUMENTS

| | | | |
|---|---|---|---|
| 2,599,542 | 6/1952 | Carlson | 430/69 |
| 3,269,066 | 8/1966 | Straub | 51/319 |
| 4,419,875 | 12/1983 | DeClark et al. | 72/431 |
| 4,432,220 | 2/1984 | Loersch et al. | 72/431 |
| 4,451,546 | 5/1984 | Kawamura et al. | 430/69 |
| 4,514,483 | 4/1985 | Matsuura et al. | 430/69 |
| 4,514,582 | 4/1985 | Tiedje et al. | 136/256 |
| 4,554,727 | 11/1985 | Deckman et al. | 29/572 |

FOREIGN PATENT DOCUMENTS

| | | |
|---|---|---|
| 3321648 | 12/1983 | Fed. Rep. of Germany . |
| 753692 | 11/1953 | United Kingdom . |

*Primary Examiner*—John L. Goodrow

*Attorney, Agent, or Firm*—Fitzpatrick, Cella, Harper & Scinto

[57] ABSTRACT

A surface-treated metal body comprises a metal body having a plurality of spherical indent recesses as irregularities formed on the surface, and further having fine irregularities formed in the spherical indent recesses.

26 Claims, 5 Drawing Sheets

SURFACE-TREATED METAL BODY, PROCESS FOR PRODUCING THE SAME, PHOTOCONDUCTIVE MEMBER USING THE SAME AND RIGID BALL FOR TREATING METAL BODY SURFACE

This application is a continuation of application Ser. No. 894,958, filed Aug. 8, 1986, now abandoned.

BACKGROUND OF THE INVENTION

1. Field of the Invention

This invention relates to a structural member of electric or electronic device, particularly to a surface-treated metal body utilizable as a substrate of a photoconductive member such as an electrophotographic photosensitive member, etc., and to a process for producing the same, a photoconductive member using the surface-treated metal body, and a rigid ball for treating the metal body surface.

2. Related Background Art

Various cutting or grinding treatments have been applied to a metal body surface to give a desired surface shape, depending on their uses.

For example, metal bodies of plate shape, cylindrical shape, endless belt shape, etc. are used as substrates (supports) of a photoconductive member such as electrophotographic photosensitive member, etc., and their surfaces are finished by cutting treatment to form a mirror surface, etc., as a preliminary step for forming layers such as a photoconductive layer, etc. on the support. For example, the surfaces are finished to a surface flatness within a given range by diamond cutting tool cutting with a lathe, a milling machine, etc., or sometimes to an irregularity of given or desired shape to prevent an interference fringe.

However, in the formation of such a surface by cutting, the cutting tool contacts fine ingredients existing near the surface of a metal body, such as rigid alloy components, oxides, etc. or blisters, thereby lowering the cutting efficiency, and also the surface defects due to the ingredients, etc. are liable to appear by the cutting. For example, an aluminum alloy, when used as a support metal body, has ingredients such as intermetallic compounds, e.g. Si-Al-Fe, Fe-Al, $TiB_2$, etc. or oxides of Al, Mg, Ti, Si, and Fe or blisters by $H_2$ in the aluminum structure, and also has surface defects such as grain boundary discrepancy taking part between the adjacent Al structures of different crystal orientations. When, for example, an electrophotographic photosensitive member is made from a support having such a surface defect, no uniform layers can be obtained, and consequently the photosensitive member cannot have uniform electrical, optical and photoconductive characteristics, and fails to produce a good image. That is, such a photosensitive member cannot meet the practical purpose.

The cutting treatment also has other problems such as producing of powdery cutting wastes, consumption of cutting oil, complicated disposal of the powdery cutting wastes, and treatment of cutting oil remaining on the cut surface.

Besides the cutting means, the conventional means for plastic deformation, such as sand blast, shot blast, etc. are used to control the surface flatness or surface roughness of the metal body, but the shape irregularity, precision, etc. of the metal body surface cannot be exactly controlled by such means.

Furthermore, when the surface roughness is attained by the foregoing means, an irregular state, for example, a relatively large and acute irregular state, is exposed on the surface, and thus the durability of the resulting photosensitive member is considerably deteriorated against repeated frictions by a cleaning means, etc.

SUMMARY OF THE INVENTION

An object of the present invention is to provide a surface-treated metal body whose surface has been finished or given an irregularity by a novel process.

Another object of the present invention is to provide a surface-treated metal body whose surface has been finished without any cutting treatment liable to cause surface defects that deteriorate the desired use characteristics.

Yet another object of the present invention is to provide a surface-treated metal body whose surface has been finished to a desired mirror surface degree or a non-mirror surface, or a desired shape irregularity.

A further object of the present invention is to provide a process for producing a surface-treated metal body, which can finish a metal body surface to a desired degree of mirror surface or to a non-mirror surface, or can give a desired shape irregularity to the metal body surface.

A still further object of the present invention is to provide a photoconductive member having a good uniformity in formed films; electrical, optical and photoconductive characteristics; and durability by using a surface-treated metal body whose surface has been finished to a desired surface flatness or given a desired surface irregularity without causing surface defects, etc. as a support.

Another object of the present invention is to provide an electrophotographic photoconductive member of high durability without any disadvantage of interference fringe, etc. by using a metal body effective for cancelling an optical interference fringe and attaining scattering by the surface treatment as a support.

Another object of the present invention is to provide an electrophotographic photoconductive member capable of producing an image of high quality with less image defects.

A still further object of the present invention is to provide a rigid ball suitable for the surface treatment of a metal body for use as a support of an electrophotographic photoconductive member, which can form an image of high quality without any interference fringe, etc.

DESCRIPTION OF THE PREFERRED EMBODIMENTS

Figure 1:
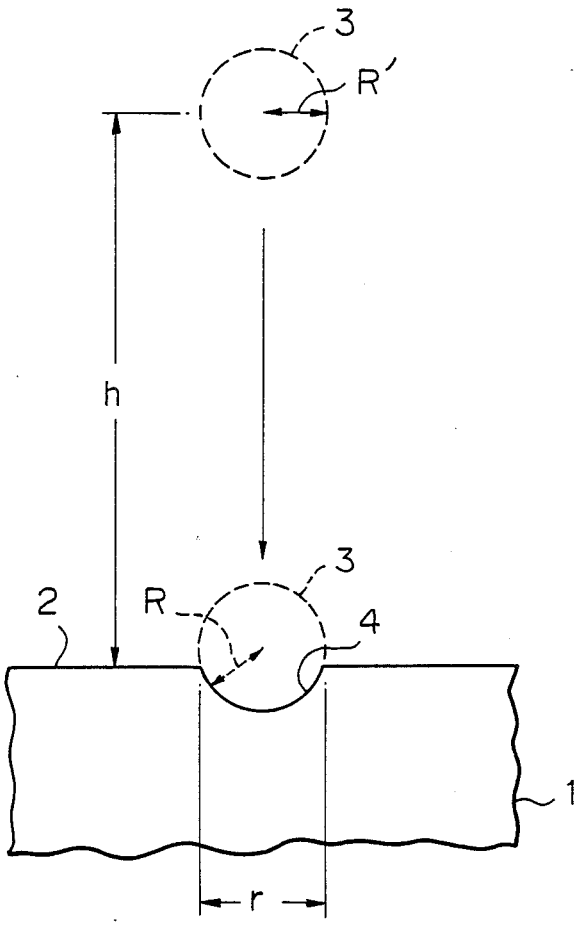
FIGS. 1 to 4 are schematic views for explaining the irregular state of a metal body surface, formed according to the present invention.

A surface-treated metal body 1 of the present invention shown in FIG. 1 has an irregularity caused by a plurality of spherical indent recesses 4 on the surface 2 as one of its features. That is, the spherical indent recess 4 is formed on the surface 2 by naturally or forcedly dropping, for example, a rigid ball 3 from a given level from the surface 2. Thus, a plurality of spherical indent recesses 4 bearing substantially same radius of curvature R and width r can be formed on the surface 2 by dropping a plurality of rigid balls 3 having a substantially equal radius R' from a substantially equal level h.

Figure 2:
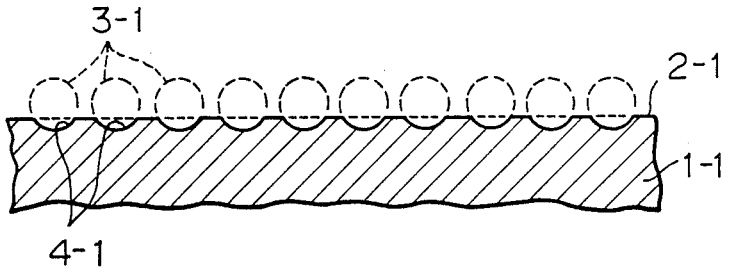
Figure 3:
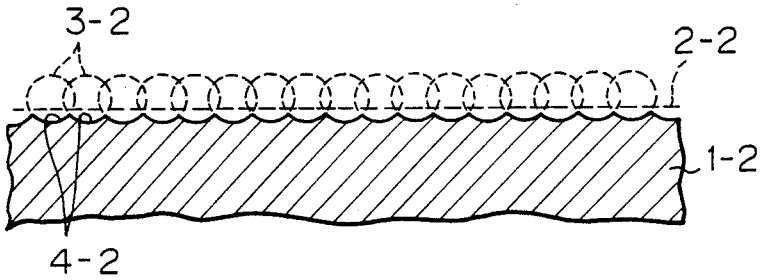

FIGS. 2 and 3 show indent recesses formed in such a case.

In FIG. 2, it is shown that a plurality of recesses 4-1, 4-1, . . . of substantially same radius of curvature and width are loosely formed without any overlapping by dropping a plurality of balls 3-1, 3-1, . . . of substantially same radius from substantially same levels onto different positions on the surface 2-1 of the metal body 1-1, thereby forming the irregularity.

In FIG. 3, it is shown that a plurality of recesses 4-2, 4-2, . . . of substantially same radius of curvature and width are densely formed with overlapping by dropping a plurality of balls 3-2, 3-2, . . . of substantially same radius from substantially same levels onto different positions on the surface 2-2 of the metal body 1-2, thereby reducing the level of irregularities (surface roughness), as compared with the embodiment of FIG. 2. In this case, it is needless to say that the balls must be naturally dropped so that the timing for forming overlapped recesses 4-2, 4-2, . . . , that is, the timing of allowing the balls 3-2, 3-2, . . . to hit the surface 2-2 of metal body 1-2 can be staggered.

Figure 4:
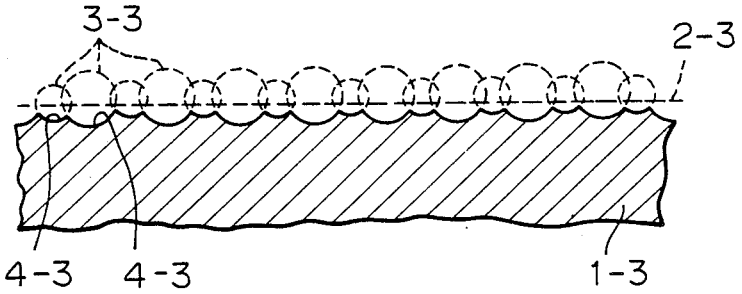

In FIG. 4, on the other hand, it is shown that a plurality of recesses 4-3, 4-3, of different radius of curvatures and widths . . . are densely formed with overlapping on the surface 2-3 of a metal body 1-3 by allowing balls of several different radiuses 3-3, 3-3, . . . from substantially same levels or from different levels, thereby form irregularities of different levels on the surface 2-3.

In this manner, plurality of spherical indent recesses of desired radius of curvature and width can be formed at a desired density on the surface of a metal body by appropriately adjusting conditions such as the hardness of the rigid balls and the metal body surface, the radius of the rigid balls, the dropping level, the weight of falling balls, etc. Therefore, the surface roughness, that is, the finishing of the metal body surface to a mirror surface, or non-mirror surface; the levels and pitches of irregularities, etc. can be adjusted as desired, or irregularities of a desired shape depending on the final use can be formed by selecting the aforementioned conditions.

Furthermore, the poor surface state of a port hole tube, or mandrel-extruding or withdrawing Al pipe can be rectified according to the present process, thereby finishing the surface state to a desired state. This can be attained by plastic deformation of the surface irregularities by bombardment of rigid balls.

Figure 5:
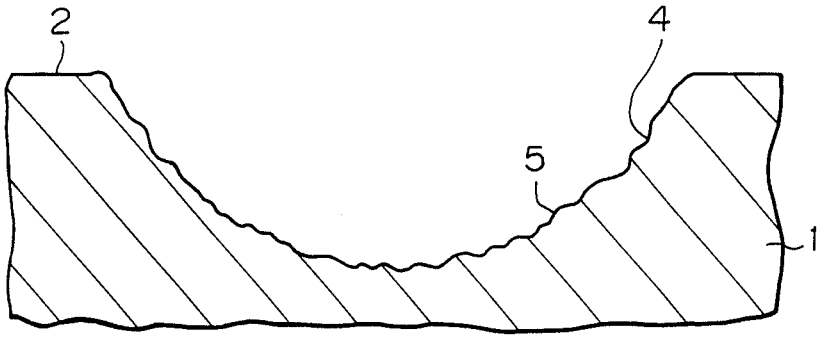
FIG. 5 is an enlarged, cross-sectional view of a spherical indent recess in FIG. 1.
Figure 6:
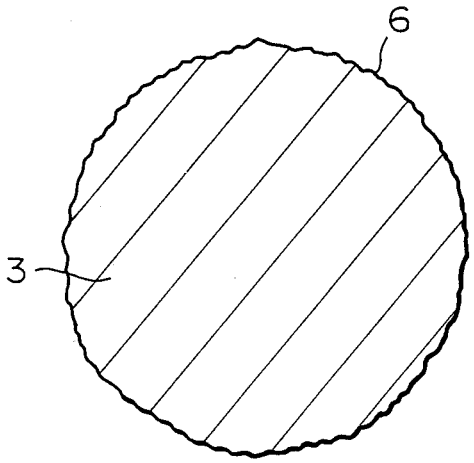
FIG. 6 is a cross-sectional view of a rigid ball for the surface treatment according to the present invention.

The present surface-treated metal body 1 has further fine irregularities in the spherical indent recesses 4 as another feature. That is, as shown in FIG. 5 as enlarged, fine irregularities or groups of fine irregularities 5 are formed on a part or the whole of the surface in the spherical indent recess 4. Such fine irregularities are formed by using a rigid ball having irregularities 6 on the surface, for example, as shown in FIG. 6, as a rigid ball 6.

The rigid balls having irregularities can be formed by plastic processing treatment such as embossing, corrugation forming, etc.; surface roughing such as satinizing, etc.; formation of surface irregularities by mechanical treatment; and formation of surface irregularities by chemical treatment such as etching treatment, etc. Furthermore, the surface of the rigid ball having the thus formed irregularities can be subjected to a surface treatment such as electrolytic polishing, chemical polishing, finish polishing, etc., or film formation by anodic oxidization, film formation by chemical reaction, plating, enameling, coating, formation of vapor deposit film, film formation by CVD, etc. to appropriately adjust the shape irregularity (level of irregularities), hardness, etc.

As materials for the present surface-treated metal body, any kind of metals can be used, depending on the use purpose, but aluminum and aluminum alloys, stainless steel, steel, copper and copper alloys, magnesium alloys, etc. are practical. A metal body of any shape can be used. For example, such shapes as a plate shape, a cylindrical shape, a columnar shape, an endless belt shape, etc. are applicable, for example, as a substrate (support) of an electrophotographic photosensitive member.

The rigid balls for use in the present invention include various rigid balls of, for example, such metals as stainless steel, aluminum, steel, nickel, brass, etc., ceramics, plastics, etc., and particularly stainless steel and steel rigid balls are preferable owing to the long durability and low cost. The hardness of the ball may be higher or lower than that of the metal body, but it is preferable to make it higher than the hardness of a metal body when the balls are to be used repeatedly.

The present surface-treated metal body is preferable for a support of a photoconductive member such as an electrophotographic photosensitive member, etc.; a magnetic disc substrate for computer memory and a polygonal mirror substrate for laser scanning. Furthermore, other than the above, the present surface-treated metal body is also suitable as a structural member for various electrical and electronic devices whose surface has been so far finished to a surface roughness of $R_{max}=1$ μm or less, preferably $R_{max}=0.05$ μm or less by such a means as mirror surface finish by diamond cutting tool, cylinder grinding finish, lapping finish, etc.

When the present surface-finished metal body is used as a support for an electrophotographic photosensitive drum, a port hole tube or a mandrel pipe obtained by the ordinary extrusion processing of aluminum alloy, etc. is further subjected to a drawing processing, and the resulting drawn cylinder is further subjected to heat treatment, quality modification treatment, etc., if required. Then, the cylinder is subjected to surface treatment in an apparatus shown, for example, in FIG. 7 (schematic lateral cross-sectional view) and FIG. 8 (schematic longitudinal cross-sectional view) according to the present process, whereby the support can be formed.

Figure 7:
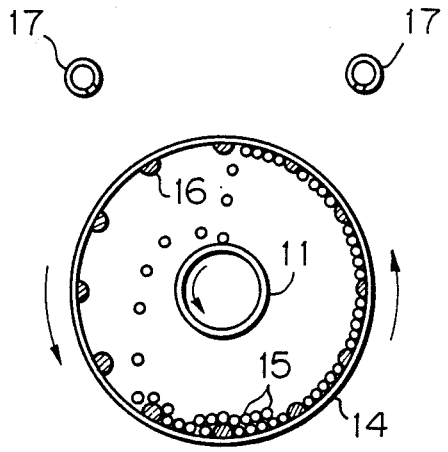
FIGS. 7 and 8 are a lateral cross-sectional view and a longitudinal cross-sectional view, respectively, of one embodiment of an apparatus for carrying out a process for producing a surface-treated metal body according to the present invention.
Figure 8:
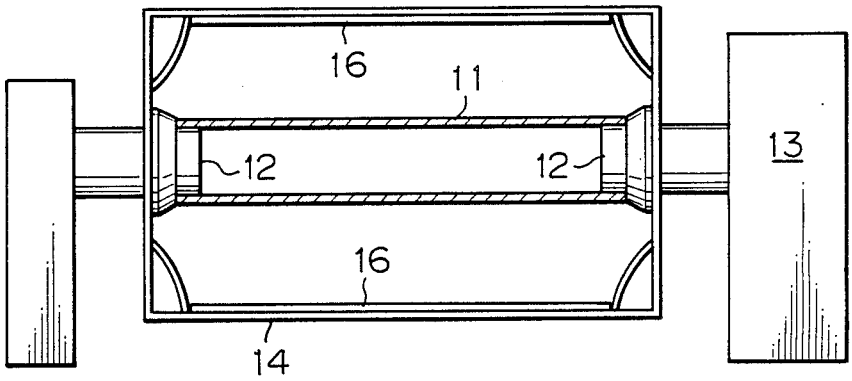

In FIGS. 7 and 8, numeral 11 is an aluminum cylinder for forming a support. The cylinder 11 may be a drawn pipe as such or the one whose surface is finished to an appropriate surface precision. The cylinder 11 is supported by bearings 12, and driven by an appropriate driving means 13 such as a motor, etc. and rotatable substantially around the axis center. Numeral 14 is a rotary vessel supported by the bearings 12 and rotatable in the same direction as that of the cylinder 11, and contains a large number of rigid balls 15 having irregularities on the surfaces.

The rigid balls 15 are supported by a plurality of ribs 16 inwardly projected at the inside wall of the vessel 14, and transported up to the upper part of the vessel by rotation of the vessel 14, and then allowed to fall onto the cylinder 11.

The rotary speed and the diameters of cylinder 11 and rotary vessel 14 containing the rigid balls 15 are appropriately selected and controlled in view of the density of indent recesses to be formed, the feed rate of rigid balls, etc. By rotation of the rotary vessel 14, the rigid balls 15 transported as attached to the vessel wall at an appropriate rotary speed can be made to fall to bombard the cylinder 11, whereby indent recesses are formed on the cylinder surface. That is, the irregularities are formed thereon.

By uniformly providing holes on the wall of vessel 14 to make a mechanism to inject a washing solution from shower tubes 17 at the outside of vessel 14 when rotated, the cylinder 14, rigid balls 15 and rotary vessel 14 can be washed, where dusts, etc. electrostatically deposited through contact with the rigid balls themselves or the rigid balls and the rotary vessel can be washed out of the rotary vessel, and the desired support can be obtained. To prevent uneven drying or liquid dripping, it is preferable to use a non-volatile substance alone, or, a mixture thereof with an ordinary washing liquid such as triethane, trichlene, etc. as the said washing solution.

An example of the structure of the present photoconductive member will be described below:

The present photoconductive member is composed of a support and a photosensitive layer containing, for example, an organic photoconductive material or an inorganic photoconductive material, provided on the support.

The shape of the support is selected as desired. For example, when the support is used for the electrophotography, an endless belt shape or said cylindrical shape is desirable for continuous high speed copying. The thickness of the support is so selected to form a photoconductive member as desired, but when a flexibility is required as a photoconductive member, the support is made as thin as possible so long as the function as the support can be satisfactorily obtained. However, even in such a case the thickness is usually at least 400 μm from the viewpoint of production of the support, handling, mechanical strength, etc.

The support is subjected to the surface treatment according to the present invention, whereby the surface is finished to a mirror surface, or finished to a non-mirror surface or given shape irregularities as desired for the purpose of prevention of any interference fringe, etc. For example, when the surface of a support is made into a non-mirror surface or roughened by giving irregularities to the surface, the surface of a photosensitive layer is also made irregular in accordance with the irregularities of the support surface, but at the exposure to a light, there appears a phase difference in the reflected light on the support surface and the photosensitive layer surface, causing an interference fringe due to the shearing interference, or causing black spots (black dots) or stripes (line) at a reversal development. This leads to image defects. These phenomena are particularly pronounced in the case of exposure to a laser beam as an interferable light.

In the present invention, such an interference fringe can be prevented by adjusting the radius of curvature R and the width r of spherical indent recesses formed on the support surface. That is, in the case of using the present surface-treated metal body as a support, at least 0.5 Newton rings exist due to the shearing interference in the individual indent recesses when r/R is 0.035 or more, and the interference fringes on the entire photoconductive member can be made to exist as dispersed in the individual indent recesses, and thus the interference can be prevented. The upper limit of r/R is not particularly limited, but r/R is desirably selected within the range of $0.035 \leqq r/R \leqq 0.5$, because, if r/R exceeds 0.5, the width of the recess becomes relatively large and image unevenness, etc. are liable to develop.

The radius of curvature R of the indent recess is selected desirably within the range of $0.1\ \text{mm} \leqq R \leqq 2.0\ \text{mm}$, more desirably within the range of $0.2\ \text{mm} \leqq R \leqq 0.4\ \text{mm}$. If R is less than 0.1 mm, the falling height must be maintained while making the rigid balls smaller and lighter, and the formation of indent recesses undesirably becomes less controllable. The allowance for r selection will be naturally narrowed. If R exceeds 2.0 mm on the other hand, the falling height must be adjusted while making the rigid balls larger and heavier, and, for example, if r is desired to be relatively small, it is necessary to extremely make the falling height smaller. That is, the formation of the indent recesses is also less controllable.

The width r of indent recesses is desirably 0.02 to 0.5 mm. When r is less than 0.02 mm, the falling height must be also maintained while making the rigid balls smaller and lighter, and the formation of indent recesses undesirably is also less controllable. Furthermore, it is desirable that r is less than the light irradiation spot diameter, and particularly less than the resolving power when a laser beam is used. When r exceeds 0.5, image unevenness, etc. are liable to appear and it is highly liable to exceed the resolving power.

When rigid balls having irregularities on the surfaces are used to form fine irregularities in the individual indent recesses, the effect of scattering by the fine irregularities can be added to the aforementioned effect of preventing the interference, and thus the interference can be prevented with much more assuredness.

In the conventional art, the surface of a metal support for use in a photoconductive member is roughed at random to make a diffused reflection, thereby preventing an occurrence of interference fringe. However, in this case, in the cleaning after the image transfer, for example, by use of a blade, the blade edge mainly contacts the convex parts of the irregularities, deteriorating the cleanability or increasing an attrition of the photoconductive member and the blade edge at the convex parts. As a result, a good durability of the photoconductive member and the blade edge cannot be obtained.

When the present surface-treated metal body is used as a support on the other hand, the surface treatment can be applied to the surface originally made smooth to some degree, and since the scattering surfaces exist in the recess parts (concave part), the blade edge does not contact the convex parts, but contacts the uniform flat surface throughout the cleaning. Thus, no large load is applied to the blade or the surface of photoconductive member, and the durability of the blade and the photoconductive member can be increased.

For obtaining an image of high quality, the level of fine irregularities given to the indent recesses, that is, the surface roughness, $R_{max}$, is desirable within a range of 0.5 to 20 μm. Below 0.5 μm, no satisfactory scattering effect can be obtained, whereas above 20 μm the fine irregularities become too large, as compared with the irregularities of indent recesses, and consequently the indent recesses lose the spherical state, and no satisfactory effect of preventing the interference fringe can be obtained. Furthermore, the unevenness of a photoconductive layer is promoted, and the image defects are liable to develop.

When a photosensitive layer composed of, for example, an organic photoconductor is provided on the support of the present photoconductive member, the photosensitive layer can be functionally separated into a charge generation layer and a charge transport layer. Furthermore, an intermediate layer composed of, for example, an organic resin, can be provided between the photosensitive layer and the support, for example, to inhibit carrier injection from the photosensitive layer to the support or to improve the adhesiveness of the photosensitive layer to the support. The charge generation layer can be formed by dispersing at least one of well known azo pigments, quinone pigments, quinocyanine pigments, perylene pigments, indigo pigments, bisbenzimidazole pigments, quinacridone pigments, azulene compounds disclosed in Japanese patent application Kokai (Laid-open) No. 165263/82, metal-free phthalocyanine pigments, metal ion-containing phthalocyanine pigments, etc. as a charge-generating material into a binder resin such as polyester, polystyrene, polyvinylbutyral, polyvinylpyrrolidone, methyl cellulose, polyacrylic acid esters, cellulose esters, etc. by use of an organic solvent, followed by coating of the dispersion. The dispersion contains 20 to 300 parts by weight of the binder resin per 100 parts by weight of the charge-generating material. The desirable thickness of the charge generation layer is in a range of 0.01 to 1.0 μm.

The charge transport layer can be formed by dispersing positive hole transport substances such as compounds having polycyclic aromatic compounds such as anthracene, pyrene, phenanthrene, coronene, etc. for example in the main chain or the side chain, or compounds having a nitrogen-containing cyclic compound such as indole, oxazole, isooxazole, thiazole, imidazole, pyrazole, oxadiazole, pyrazoline, thiadiazole, triazole, etc., or hydrazone compounds, etc. into a binder resin such as polycarbonate, polymethacrylic acid esters, polyacrylate, polystyrene, polyester, polysulfone, styrene-acrylonitrile copolymer, styrene-methyl methacrylate copolymer, etc. by use of an organic solvent, followed by coating of the dispersion. The thickness of the charge transport layer is 5 to 20 μm.

The charge generation layer and the charge transport layer can be laid upon one another in any desired order of lamination. For example, the lamination can be made in the order of the charge generation layer and the charge transport layer from the support side or, in the reversed order of lamination thereto.

The aforementioned photosensitive layer is not limited to the above, but it is also possible to use a photosensitive layer using a charge transfer complex composed of polyvinylcarbazole and trinitrofluorenone disclosed in IBM Journal of the Research and Development, January issue (1971) pp. 75–89, a pyrrilium-based compound disclosed in U.S. Pat. Nos. 4,395,183; 4,327,169, etc., or a well known inorganic photoconductive material such as zinc oxide, cadmium sulfide, etc. as dispersed in resin, a vapor-deposited film of selenium, seleniumtellurium, etc., or a film composed of an amorphous material containing silicon atoms. Among them, a photoconductive member using a film composed of an amorphous material containing silicon atoms as a photosensitive material comprises a support of the present invention as described above, and, for example, a charge injection-preventing layer, a photosensitive layer (photoconductive layer) and a surface protective layer as successively laid on the support.

The charge injection-preventing layer is composed of, for example, amorphous silicon containing hydrogen atoms (H) and/or halogen atoms (X) [a-Si(H,X)] and contains atoms of elements belonging to groups III or V of the periodic table usually used as impurities in the semi-conductor as a conductivity-controlling substance. The thickness of the charge injection-preventing layer is preferably 0.01 to 10 μm, more preferably 0.05 to 8 μm, and most preferably 0.07 to 5 μm.

In place of the charge injection-preventing layer, a barrier layer composed of an electrically insulating material, such as $Al_2O_3$, $SiO_2$, $Si_3N_4$, polycarbonate, etc. may be provided, or both charge injection-preventing layer and barrier layer can be used together.

The photosensitive layer is composed of a-Si having, for example, hydrogen atoms and halogen atoms and contains a different conductivity-controlling substance than that used in the charge injection-preventing layer as desired. The thickness of the photosensitive layer is preferably 1 to 100 μm, more preferably 1 to 80 μm and most preferably 2 to 50 μm.

The surface protective layer is composed of, for example, $Si_{1-x}C_x(0<x<1)$, $Si_{1-x}N_x(0<x<1)$, etc., and the layer thickness is preferably 0.01 to 10 μm, more preferably 0.02 to 5 μm, and most preferably 0.04 to 5 μm.

In the present invention, a photoconductive layer composed of a-Si(H, X), etc. can be formed by so far well known vacuum deposition methods using electric discharging phenomena such as glow discharging, sputtering, ion plating, etc.

One example of a process for producing a photoconductive member by glow discharge decomposition will be described below.

Figure 9:
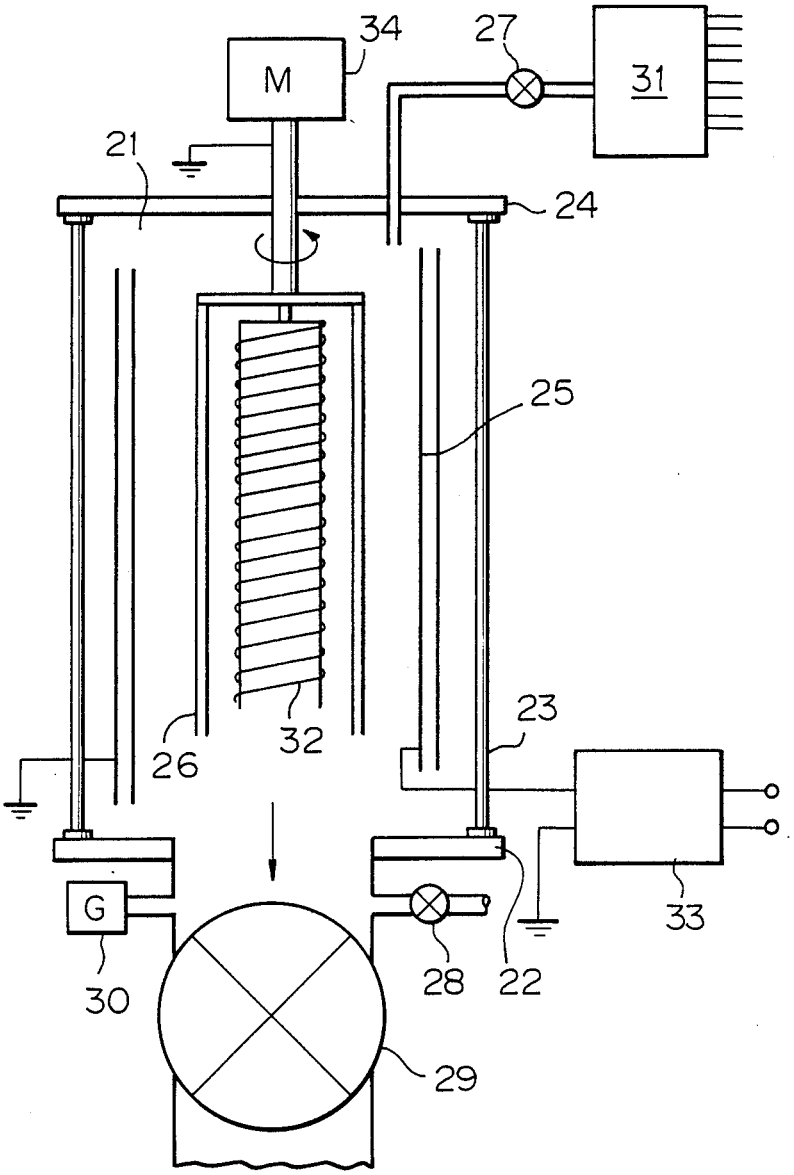
FIG. 9 is a schematic view of an apparatus for producing a photoconductive member by glow discharge decomposition.

In FIG. 9, an apparatus for producing a photoconductive member by glow discharge decomposition is shown, where a deposition vessel 21 comprises a base plate 22, a vessel wall 23, and a top plate 24, and a cathode electrodes 25 are provided in the deposition vessel 21. An aluminum alloy support 26 of the present invention, on which an a-Si(H, X) deposited film is to be formed, is provided at the center between the cathode electrodes 25 and serves as an anode electrode.

To form the a-Si(H, X) deposited film on the support in the apparatus, a starting gas inflow valve 27 and a leak valve 28 are closed at first, and an exhausting valve 29 is opened to exhaust the gas from the deposition vessel 21. When the reading on a vacuum gage 30 reaches $5\times10^{-6}$ Torr, the starting gas inflow valve 27 is opened to feed a starting gas mixture containing, for example, $SiH_4$ gas, $Si_2H_6$ gas, $SiF_4$ gas, etc. adjusted to a desired mixing ratio by a mass flow controller 31 and the degree of opening of the exhausting valve 29 is adjusted while observing the reading on the vacuum gage 30 so that the pressure in the deposition vessel 21 may reach a desired value. After it has been confirmed that the surface temperature of the drum-shaped support 26 is set to a predetermined temperature by a heater 32, a high frequency power source 33 is set to a desired power to generate glow discharge in the deposition vessel 21.

The drum-shaped support 26 is rotated at a constant speed by a motor 34 during the deposition of the layer to ensure uniform formation of the layer. In this manner, the a-Si(H, X) deposited film can be formed on the drum-shaped support 26.

The present invention will be described in detail below, referring to Examples.

TEST EXAMPLE

A SUS stainless steel rigid balls, 0.6 mm in diameter, were subjected to a chemical treatment to etch the surface, whereby irregularities were formed thereon. The treating agent for this purpose can be an acid such as hydrochloric acid, hydrofluoric acid, sulfuric acid, chromic acid, etc., or an alkali such as sodium hydroxide, etc. In the present Test Example, hydrochloric acid solutions containing one part by volume of concentrated hydrochloric acid and 1 to 4 parts by volume of pure water were used, and the shape irregularity was adjusted as desired by changing the dipping time of the rigid balls, acid concentration, etc.

The surfaces of aluminum alloy cylinders, 60 mm in diameter and 298 mm long, were treated with the thus treated rigid balls (the level of surface irregularities $R_{max}=5$ μm) in an apparatus shown in FIGS. 7 and 8 to form irregularities on the cylinder surface.

Relationships among the radius R′ of balls, the falling height h, the radius of curvature of indent recesses R, and the width r thereof were investigated. It was found that the radius of curvature of indent recesses R and the width r thereof depended on the radius of balls R′, and the falling height h. Furthermore, it was found that the pitch of the indent recesses (density of indent recesses or pitch of irregularities) could be adjusted to a desired one by controlling the rotating speed or rotation frequency of the cylinder, or the number of falling rigid balls. Furthermore, it was found that fine irregularities were formed in the indent recesses in accordance with the surface irregularities or the surface roughness of the rigid balls.

Examples 1 to 6 and Comparative Example 1

The surfaces of aluminum alloy cylinders were treated in the same manner as in Test Example, except that r/R was controlled to those given in Table 1, and used as supports for an electrophotographic photoconductive member.

At the same time, the individual surface-treated cylinders were inspected visually and by a metallographical microscope as to the surface defects (scooped scars, cracks, stripe scars, etc.) formed after the surface treatment. Results are shown in Table 1.

Then, layers were deposited on the thus surface-treated aluminum alloy cylinders by the glow discharge decomposition method as described in detail before in an apparatus for producing a photoconductive member as shown in FIG. 9 under the following conditions, and photoconductive members were produced thereby.

| Order of lamination of deposited layers | Starting gases used | Layer thickness (μm) |
|---|---|---|
| (1) Charge injection preventing layer | $SiH_4/B_2H_6$ | 0.6 |
| (2) Photoconductive layer | $SiH_4$ | 20 |
| (3) Surface protective layer | $SiH_4/C_2H_4$ | 0.1 |

The thus produced respective photoconductive members were provided in a test machine, modified laser beam printer LBP-X made by Canon K.K. and subjected to image formation to make overall evaluation of interference fringe, black dots, image defects, etc. The results are shown in Table 1.

For comparison, a photoconductive member was produced from an aluminum alloy cylinder whose surface was treated by the conventional diamond cutting tool in the same manner as above and likewise subjected to the overall evaluation.

TABLE 1

| Example No. (r/R) | Number of defects generated during the surface treatment | Results of overall evaluation (*) of interference fringe, black spots and image defects |
|---|---|---|
| Ex. 1 (0.02) | 0 | ▲ |
| Ex. 2 (0.036) | 0 | Δ |
| Ex. 3 (0.05) | 0 | ○ |
| Ex. 4 (0.1) | 0 | ○ |
| Ex. 5 (0.2) | 0 | ⊙ |
| Ex. 6 (0.4) | 0 | ⊙ |
| Comp. Ex. 1 (−) | Numerous | x |

(*) x Practically unacceptable
Slightly poor in practical use in the high quality image recording
Δ Practically acceptable in the high quality image recording
Practically good in the high quality image recording
Practically very good in the high quality image recording (*) x Practically unacceptable
▲Slightly poor in practical use in the high quality image recording
Δ Practically acceptable in the high quality image recording
o Practically good in the high quality image recording
⊙Practically very good in the high quality image recording In the supports for photoconductive members of Examples 1 to 6, R was in a range of 0.1 to 2.0 mm and r was in a range of 0.02 to 0.5 mm.

Examples 7 to 10 and Comparative Example 2

Photoconductive members were produced in the same manner as in Example 5 except that rigid balls having the levels of surface irregularities ($R_{max}$) shown in Table 2 were used. The thus obtained photoconductive members were evaluated in the same manner as in Table 1, and the results as shown in Table 2.

TABLE 2

| Example No. ($R_{max}$) | Number of defects generated during the surface treatment | Results of overall evaluation (*) of interference fringe, black spots and image defects |
|---|---|---|
| Ex. 5 | 0 | ⊙ |

TABLE 2-continued

| Example No. ($R_{max}$) | Number of defects generated during the surface treatment | Results of overall evaluation (*) of interference fringe, black spots and image defects |
|---|---|---|
| (5) | | |
| Ex. 7 (<0.5) | 0 | Δ |
| Ex. 8 (2) | 0 | ○ |
| Ex. 9 (10) | 0 | ◎ |
| Ex. 10 (20) | 0 | ◎ |
| Comp. Ex. 2 (50) | 0 | x Many black spots were generated. |

(*) The evaluation standard of x, ▲, Δ, ○ and ◎ is the same as in Table 1.

Examples 11 and 12

Photoconductive members were produced in the same manner as in Examples 1 to 6, except that the layer formation was carried out as given below. That is, two photoconductive members were produced from aluminum alloy cylinders whose surface had an r/R of 0.2 (Example 11) and 0.1 (Example 12), respectively.

At first, an intermediate layer having a layer thickness of 1 μm was formed by use of a coating solution of copolymerized nylon resin in a solvent.

Then, a coating solution containing ϵ-type copper phthalocyanin and butyral resin as a binder resin was applied to the intermediate layer to form a charge generation layer having a layer thickness of 0.15 μm, and then a coating solution containing a hydrazone compound and styrene-methyl methacrylate copolymer resin as a binder resin was applied to the charge generation layer to form a charge transport layer having a layer thickness of 16 μm, whereby the photoconductive members were produced.

The thus obtained photoconductive members were subjected to overall evaluation in the same manner as in Examples 1 to 6, and it was found that those of Examples 11 and 12 were practical and particularly that of Example 11 was distinguished.

The surface-treated metal body of the present invention can be obtained by surface treatment without any cutting processing which is liable to develop surface defects deteriorating the desired use characteristics, and when the present metal body is used as a support of a photoconductive member, there can be obtained a photoconductive member excellent in uniformness of layers and uniformness of electrical, optical and photoconductive characteristics. Particularly when the photoconductive member is used as an electrophotographic photosensitive member, an image of high quality with less image defects can be obtained. Particularly when an interferable light such as a laser beam, etc. is used, an image without any interference fringe can be obtained.

Fine irregularities can be formed in indent recesses by rigid balls whose surfaces are made irregular, and thus more precise irregularities can be formed, whereby a distinguished image without any interference fringe can be formed also by virtue of the scattering effect.

We claim:

1. A surface-treated metal body which comprises a cylindrical metal body for an electrophotographic photoconductive member having a plurality of spherical indent recesses as irregularities formed on the surface, and further having fine irregularities formed in the spherical indent recesses, wherein the ratio of the radius of curvature R and the width r of the spherical indent recesses are in a range of $0.035 \leqq r/R \leqq 0.5$ and wherein the radius of curvature R of the spherical indent recesses is in a range of $0.1\ mm \leqq R \leqq 2.0\ mm$.

2. A surface-treated metal body according to claim 1, wherein the irregularities are formed by spherical indent recesses having substantially equal radius of curvature and width.

3. A photoconductive member capable of being scanned with a laser beam comprising a photoconductive layer on a support, the support being a surface-treated metal body having irregularities formed through a plurality of spherical indent recesses on the surface and also having fine irregularities formed in the spherical indent recesses, wherein the ratio of the radius of curvature R and the width r of the spherical indent recesses are in a range of $0.035 \leqq r/R \leqq 0.5$ and wherein the radius of curvature R of the spherical indent recesses is in a range of $0.1\ mm \leqq R \leqq 2.0\ mm$.

4. A photoconductive member according to claim 3, wherein the irregularities are formed through the spherical indent recesses of substantially same radius of curvature and width.

5. A photoconductive member according to any one of claims 3 to 4, wherein the width r of the spherical indent recesses is in a range of $0.02\ mm \leqq r \leqq 0.5\ mm$.

6. A photoconductive member according to any one of claims 3 or 4, wherein the levels of the fine irregularities in the spherical indent recesses is in a range of 0.5 to 20 μm.

7. A photoconductive member according to claim 3, wherein the support is composed of aluminum alloy.

8. A photoconductive member according to claim 3, wherein the support is an aluminum alloy cylinder.

9. A photoconductive member according to claim 3, wherein the photoconductive layer contains an organic photoconductive material.

10. A photoconductive member according to claim 3, wherein the photoconductive layer comprises a charge generation layer and a charge transport layer.

11. A photoconductive member according to claim 10, wherein the thickness of the charge generation layer ranges from 0.01–1.0μ.

12. A photoconductive member according to claim 10, wherein the thickness of the charge transport layer ranges from 5–20μ.

13. A photoconductive member according to claim 10, wherein the charge generation layer comprises a mixture of 20 to 300 parts by weight of a binder per 100 parts by weight of a charge-generating material.

14. A photoconductive member according to claim 7, wherein the photoconductive layer is composed of an amorphous silicon.

15. A photoconductive member according to claim 7, wherein a charge injection-preventing layer is spaced between the support and the photoconductive layer.

16. A photoconductive member according to claim 15, wherein the charge injection-preventing layer is composed of an amorphous silicon containing at least one of hydrogen atoms and halogen atoms.

17. A photoconductive member according to claim 16, wherein the charge injection-preventing layer contains at least one member of elements in Group III or Group V of the Periodic Table.

18. A photoconductive member according to claim 7, wherein a barrier layer is spaced between the support and the photoconductive layer.

19. A photoconductive member according to claim 18, wherein the barrier layer is composed of an electrically insulating material.

20. A photoconductive member according to claim 18, wherein the barrier layer is composed of a material selected from the group consisting of $Al_2O_3$, $SiO_2$, $Si_3N_4$, and polycarbonate.

21. A photoconductive member according to claim 15, wherein the thickness of the charge injection-preventing layer ranges from 0.01 to 10μ.

22. A photoconductive member according to claim 14, wherein the amorphous silicon is prepared by the glow discharge method.

23. A photoconductive member according to claim 7, wherein a surface protective layer is on the photoconductive member.

24. A photoconductive member according to claim 23, wherein the thickness of the surface protective layer ranges from 0.01–10μ.

25. A photoconductive member according to claim 23, wherein the surface protective layer is composed of a material selected from the group consisting of $Si_xC_{1-x}$, $Si_xN_{1-x}$, and $Si_xO_{1-x}$ $(0<x<1)$.

26. A photoconductive member according to claim 7, wherein the thickness of the photoconductive layer ranges from 1–100μ.

* * * * *

UNITED STATES PATENT AND TRADEMARK OFFICE

CERTIFICATE OF CORRECTION

PATENT NO. : 4,939,057

DATED : July 3, 1990

INVENTOR(S) : MITSURU HONDA, ET AL.

It is certified that error appears in the above-identified patent and that said Letters Patent is hereby corrected as shown below:

On the title page:

IN [56] REFERENCES CITED

U.S. PATENT DOCUMENTS, Insert --1,328,603 1/1920 Stirling ..... 51/7--.

COLUMN 3

Line 44, "plurality" should read --a plurality--.

COLUMN 5

Line 32, "below:" should read --below.--.
Line 44, "required as" should read --required in--.

COLUMN 7

Line 24, "well" should read --well- --.
Line 68, "well known" should read --well-known--.

COLUMN 8

Line 3, "seleniumtellurium," should read --selenium-tellurium,--.
Line 39, "well known" should read --well-known--.
Line 48, "a" (third occurrence) should be deleted.

--

UNITED STATES PATENT AND TRADEMARK OFFICE

CERTIFICATE OF CORRECTION

PATENT NO. : 4,939,057

DATED : July 3, 1990

INVENTOR(S) : MITSURU HONDA, ET AL.

It is certified that error appears in the above-identified patent and that said Letters Patent is hereby corrected as shown below:

COLUMN 9

Line 13, "A" should be deleted.

COLUMN 10

TABLE 1, "Slightly poor" should read --▲Slightly poor--; "Practically good" should read --○Practically good--; and "Practically very" should read --◎Practically very--.

Lines 41-50, Lines 41-50 should be deleted.

COLUMN 11

TABLE 2-continued, " Ex. 8 (2) 0 ○"

should read -- Ex. 8 (2) 0 ◎--.

and " Ex. 10 (20) 0 ◎"

should read -- Ex. 10 (20) 0 ○--.

UNITED STATES PATENT AND TRADEMARK OFFICE

CERTIFICATE OF CORRECTION

PATENT NO. : 4,939,057

DATED : July 3, 1990

INVENTOR(S) : MITSURU HONDA, ET AL.

It is certified that error appears in the above-identified patent and that said Letters Patent is hereby corrected as shown below:

COLUMN 11

Line 30, "phthalocyanin" should read --phthalocyanine--.

Signed and Sealed this

Second Day of June, 1992

*Attest:*

*Attesting Officer*

DOUGLAS B. COMER

*Acting Commissioner of Patents and Trademarks*